US005355765A

United States Patent [19]

Rogers

[11] Patent Number: 5,355,765

[45] Date of Patent: Oct. 18, 1994

[54] HIGH PERFORMANCE GUN BARREL

[76] Inventor: Ernest Rogers, 1735 E. Cherokee, Pleasant Grove, Utah 84062

[21] Appl. No.: 985,173

[22] Filed: Dec. 2, 1992

[51] Int. Cl.[5] ..... F41A 21/28

[52] U.S. Cl. ..... 89/14.4

[58] Field of Search ..... 89/14.2, 14.3, 14.4

[56] References Cited

U.S. PATENT DOCUMENTS

| | | | |
|---|---|---|---|
| 1,315,504 | 9/1919 | Humm | 89/14.3 |
| 2,503,491 | 4/1950 | Janz | 89/14.4 |
| 3,340,769 | 9/1967 | Waser | 89/14.4 |
| 3,399,597 | 9/1968 | Perrine | 89/14.4 |
| 3,776,093 | 12/1973 | Leverance et al. | 89/14.2 |
| 3,858,481 | 1/1975 | Elliott | 89/14.3 |
| 4,176,487 | 12/1979 | Manis | 89/14.4 |
| 4,501,189 | 2/1985 | Brandl et al. | 89/14.4 |
| 4,576,084 | 3/1986 | Brandl et al. | 89/14.4 |
| 4,669,212 | 6/1987 | Jackson et al. | 89/16 |
| 4,879,942 | 11/1989 | Cave | 89/14.3 |
| 4,930,396 | 6/1990 | Johnson | 89/14.3 |
| 4,942,801 | 7/1990 | Schuemann et al. | 89/14.3 |
| 5,020,416 | 6/1991 | Tripp et al. | 89/14.3 |
| 5,033,356 | 7/1991 | Richardson | 89/14.4 |
| 5,062,346 | 11/1991 | Hansen et al. | 89/14.1 |
| 5,123,329 | 6/1992 | Irwin | 89/14.3 |
| 5,136,923 | 8/1992 | Walsh | 89/14.2 |

FOREIGN PATENT DOCUMENTS

| | | | |
|---|---|---|---|
| 2448865 | 4/1976 | Fed. Rep. of Germany | 89/14.4 |
| 230502 | 10/1925 | United Kingdom | 89/14.3 |

OTHER PUBLICATIONS

Edward M. Schmidt, Muzzle Flow Gasdynamics, Gun Propulsion Technology 167 (Ludwigstiefel Ed., American Institute of Aeronautics & Astronautics, Inc. 1988).

*Primary Examiner*—David H. Brown

*Attorney, Agent, or Firm*—Trask, Britt & Rossa

[57] ABSTRACT

A barrel has an inner tube with a chamber at one end and a muzzle at the other. The barrel guides projectiles such as bullets as they are accelerated by a propellant. The inner tube has an aperture near its front end. Propellant passes through the aperture into a propellant chamber formed by the inner tube and an outer tube positioned about and secured to the inner tube. A plurality of ribs extend between the inner and outer tubes. Also, a coolant may be inserted into the propellant chamber to escape through the muzzle with the propellant after the projectile exits the muzzle.

26 Claims, 2 Drawing Sheets

HIGH PERFORMANCE GUN BARREL

BACKGROUND OF THE INVENTION

1. Field

The present invention relates to barrels for guiding a projectile through an internal bore, and, more particularly, to a gun barrel having a vent chamber.

2. State of the Art

In a typical barrel, a projectile such as a bullet is typically "fired" from a case by propelling the bullet through the barrel by a propellant. Although gunpowder is typical, other propellants may be used such as compressed gases. A tight seal is formed between the barrel and the bullet to prevent escape of propellant past the bullet.

Effective stoppage of the propellant gas within the barrel is referred to as obturation. Obturation, as generally used with regard to ordnance, refers to the function of the two enclosing seals that trap propellant gas within a gun's barrel and chamber. For a typical rifle, the two gas-tight seals are the closure of the breech by an expanded case supported by a locked bolt and the seal between the bullet and the barrel rifling. That is, in the firing of a rifle, typically the high-pressure gas formed by the burning propellant is obturated by a brass case which expands and seals tightly against the chamber walls and by a portion of the soft outer jacket of the bullet which deforms against the surfaces of the barrel rifling. Obturation is lost as the bullet exits from the muzzle and gas escapes from the barrel. This coincides with the "bang" emitted by the gun.

For a typical weapon, the ejected gas is at very high pressure and temperature which leads to formation of an underexpanded supersonic flow field near the muzzle. This supersonic flow has a higher velocity than the bullet and at first overtakes and passes the bullet.

As the gas expands outward from the muzzle, the gas velocity decreases to subsonic velocity behind the advancing shock front. Turbulent shear mixing occurs between the supersonic stream and the surrounding atmosphere, forming a combustible mixture with the fuel-rich propellant gas. Although the pressure in the expanding gas is comparatively low, the temperature in the associated shock waves is comparable to the temperature of the gas inside the muzzle, and often above the ignition temperature of the gas stream. As a result, a second explosion of the propellant may occur after it has left the barrel. The second explosion may release as much energy as the initial burn of the propellant and far more noise. The atmospheric combustion or second explosion produces the luminous muzzle flash and muzzle blast over and above the normal gun report.

As a projectile leaves the barrel, it typically passes through a reversed turbulent flow, one or more shock fronts, and possible atmospheric explosions. These phenomena may degrade the accuracy of the weapon as well as cause harm to people nearby. All of these effects are related to the remaining gas in the barrel at loss of obturation. Muzzle brakes, silencers, and other devices which discharge the propellant gas at the muzzle or through ports to the atmosphere merely change the time and location for loss of obturation and do not mitigate the undesirable effects.

The pressurized propellant gas may be created in a variety of ways. In some low-energy devices such as pellet guns, air may be compressed into a chamber by a hand operated pump. When the trigger of the gun is operated (e.g., pulled), a valve is opened. In turn, the pressurized air (or gas) is released into one end of the tube or barrel behind the pellet, which is thereby accelerated through the barrel. As the pellet accelerates, the pressurized air expands and its pressure decreases.

In high energy devices, pressurized gas is created by igniting a propellant such as gun powder. A projectile such as a bullet is placed between the propellant and the throat of the barrel. Upon combustion of the propellant, a high-pressure gas is formed very rapidly to accelerate the bullet from the throat down the length of the barrel toward the muzzle. Typically, gas formation is substantially complete before the projectile exits the barrel.

In a typical gun, peak gas pressure is achieved before the projectile has traversed one-fifth of the distance through the bore. Accordingly, gas pressure is reduced considerably by further expansion when the projectile has reached the end of travel within the barrel. For example, in a high-powered sporting rifle, the peak pressure may be approximately 50,000 pounds per square inch. In contrast, just before the bullet exits the barrel, the pressure typically has declined to about 10,000 pounds per square inch. The bullet, however, accelerates throughout the entire length of travel in response to the pressure profile. Typically, more than 80% of final velocity is achieved by the midpoint of travel in the barrel. At 90% of travel, 98% of muzzle velocity has typically been reached.

In those arrangements where an effective seal is formed between the projectile and the barrel wall, the gas pressure is still considerable as the projectile reaches the muzzle. Obturation ends as the projectile leaves the tube and a pressure wave issues from the muzzle around the base of the projectile. The gas of the gun muzzle wave or blast at first, just outside the muzzle, is traveling faster than the bullet, causing an unstable environment for a short distance. Accuracy of the weapon may thereby be adversely affected. For example, any imperfections in the base of the bullet can create an uneven pressure profile across the base of the bullet and in turn affect the trajectory. Similarly, imperfections in the muzzle crown can misdirect the gas wave or introduce turbulence to disrupt the bullet trajectory.

In large weapons, the gas wave or blast may cause dust, dirt, and the like to be thrown into the air. The result may be obscured vision and other problems associated with airborne dust and grit. Further, the muzzle flash is due in part to incandescence of hot gas as it emerges from the gun and by secondary combustion of the propellant gas after mixing with oxygen in the atmosphere. The muzzle flash can interfere with vision and can otherwise be harmful.

To regulate or control gun recoil and jump, ported barrels have been employed. In a ported barrel, a port or aperture is disposed in the wall of the barrel to allow propellant gases to ventilate through the side of the barrel before the projectile exits the barrel. The gas escapes directly to the atmosphere through the port so that obturation ends. Based on the size of the port, the recoil and muzzle jump can be controlled. Recoil compensators such as the parted barrel diminish the forward momentum of the propellant gas by deflecting it radially from the muzzle. The lateral discharge of gas from a recoil compensator, however, causes an undesirable increase in noise and blast effect.

Ported barrels may also be used to reduce the report or sound as the bullet exits the muzzle. As shown in U.S.

Pat. No. 4,501,189 (Brandl, et al.), a port is formed in the barrel near the chamber for the purpose of dissipating propellant energy before the bullet has achieved full velocity. Bullet velocity is thus restrained to less than atmospheric sonic velocity. A chamber for receiving the discharged gas is connected to the port. The ported barrel construction of Brandl, et al., however, does not serve to silence muzzle blast. To regulate the blast, a muzzle-mounrws silencer is to be used because gas pressure remains somewhat high at the time of bullet exit from the muzzle.

As known, muzzle silencers, such as the one shown in U.S. Pat. No. 3,776,093 (Leverance, et al.), may be attached at the muzzle end of the barrel. No modification of the barrel is typically required other than to provide a means of attachment. Muzzle silencers effectively reduce the sound of weapons even though the muzzle blast is still of full force. That is, the pressure has not been reduced prior to loss of obturation at the muzzle. Indeed, the effect of muzzle blast on the bullet when using a silencer is frequently worse than without the silencer. The bullet in free flight must travel through the turbulent gas in the silencer. In turn, the silencer may adversely affect accuracy.

Several other factors which affect the accuracy of a gun are barrel stiffness, barrel weight, and uneven heating of the barrel. Accuracy is typically degraded by flexure of a gun barrel during firing. A major purpose for barrel thickness and consequent weight is to provide added stiffness to improve the gun's accuracy. Barrel weight may also be increased to reduce recoil and "barrel jump," and to promote more even heating of the barrel during heavy use. Uneven heating of a gun barrel during rapid firing can cause distortion of the barrel and affect accuracy.

There remains a need for a gun barrel construction which reduces many of the deleterious effects from muzzle blast, inadequate barrel stiffness, and uneven heating of the barrel.

SUMMARY OF THE INVENTION

A barrel has an inner tube with a longitudinal axis. A bore is formed through the inner tube and defines a wall with an external surface and an internal surface. The inner tube has a muzzle and an aperture formed through the wall proximate to but spaced inwardly from the muzzle to be in fluid communication with the bore. An outer tube is positioned about the inner tube to form a chamber in fluid communication with the aperture in the inner tube to receive a substantial portion of a propellant after traverse of the aperture by the projectile. The barrel preferably includes a plurality of ribs disposed to extend between the external surface of the inner tube and the outer tube.

In a preferred arrangement, the aperture is positioned in the wall of the inner tube in the half of the inner tube toward the muzzle end. In yet an alternate configuration, the breech end has a wall thickness, which decreases or reduces along a portion of the length toward the muzzle end of the inner tube.

In preferred configurations, the outer tube is a cylinder with the inner tube sized to be snugly secured therein. The outer tube may also extend beyond the inner tube a selected portion to direct the muzzle blast away from the user.

The outer tube preferably includes a plurality of cooling fins disposed upon the external surface substantially along the longitudinal axis of the outer tube.

In a highly preferred arrangement, the enclosed chamber of the barrel contains heat-absorbing material. The heat-absorbing material absorbs heat from the fluid in the chamber. The heat-absorbing material may be a solid formed to have a high surface area to volume ratio. It may be a refractory fiber similar in structure to steel wool or it may be a finely-divided material in granular form. In yet an alternate arrangement, means are provided to supply fluid coolants such as air or carbon dioxide into the enclosed chamber. The fluid coolant also passes out through the aperture and the muzzle of the barrel after passage of the projectile past the aperture in the inner barrel.

BRIEF DESCRIPTION OF THE DRAWINGS

In the drawings which illustrate what are regarded as preferred embodiments.

DETAILED DESCRIPTION OF THE ILLUSTRATED EMBODIMENTS

To control, regulate or reduce the propellant (e.g., gas pressure) before loss of obturation, the propellant pressure behind the projectile is lowered by forming an aperture (i.e., one or more holes or channels) in the barrel wall. The aperture is in communication with a chamber positioned about or attached to the barrel. The aperture or apertures are positioned and sized to reduce the pressure in the barrel at or near the muzzle; and the chamber is sized to receive a desired volume of propellant. After loss of obturation, the propellant (e.g., gas) in the chamber escapes at a slower rate through the muzzle after the projectile has proceeded outwardly on its intended trajectory.

Figure 1:
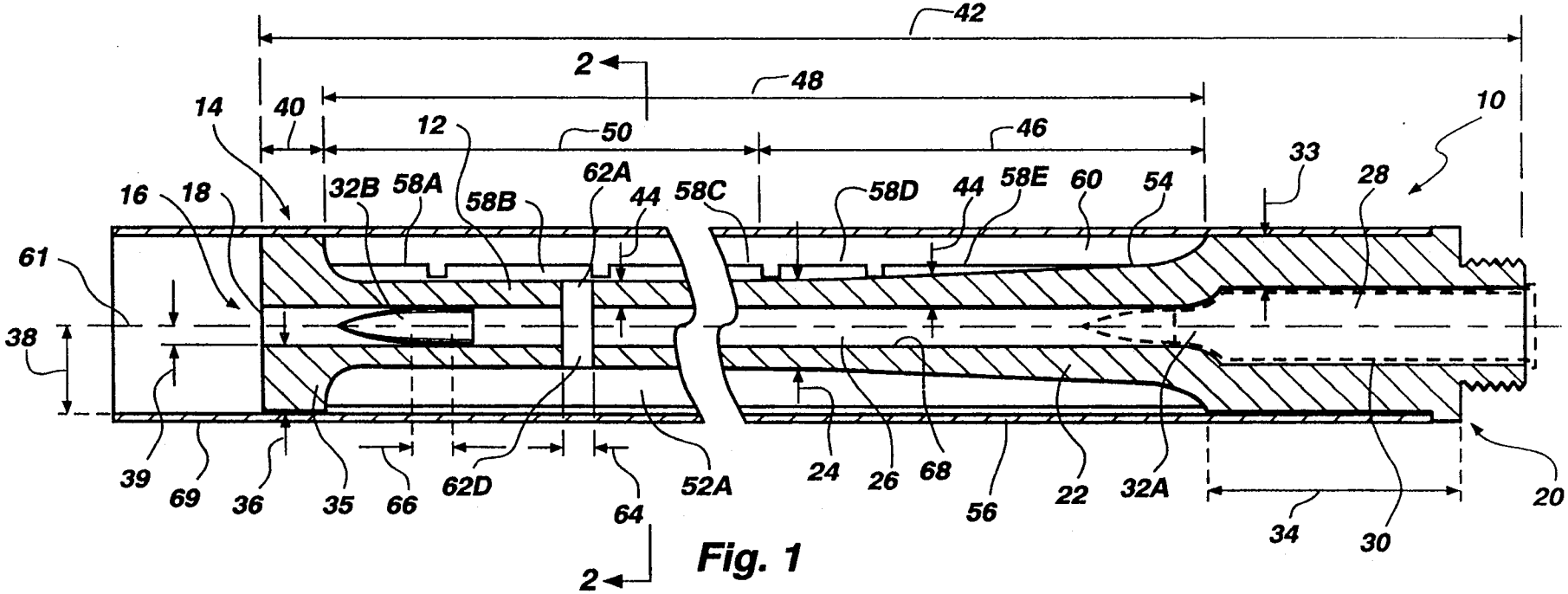
FIG. 1 is a longitudinal cross-sectional view of a barrel of the invention for use in a small firearm.
Figure 2:
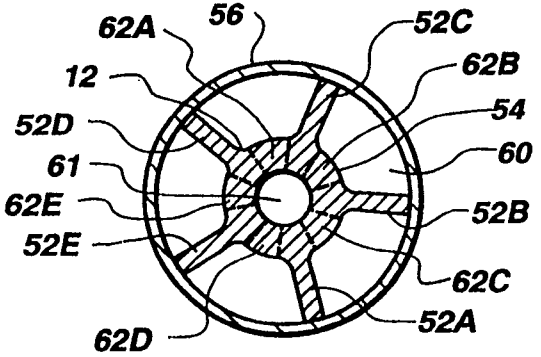
FIG. 2 is a modified cross-sectional view of the structure of FIG. 1 taken along the line 2—2.

Referring to FIGS. 1 and 2, a preferred embodiment of the high performance barrel 10 is illustrated having an internal tube 12 with a muzzle end 14, a muzzle 16 with a port 18 and a breech end 20. The tube 12 has a central portion 22 which has a reduced outside diameter 24. Internal tube 12 is formed to have a bore 26 which may or may not be rifled. At the breech end 20, a cartridge chamber 28 is constructed to accept ammunition such as a cartridge 30 with a bullet 32A.

As seen in FIG. 1, the barrel 10 has a wall thickness 33 at the breech end 20 extending the length 34 of the cartridge chamber 28. The thickness 33 is selected to withstand the high pressures experienced upon firing of a cartridge.

The muzzle end 14 of the barrel 10 is also formed to have a front portion 35 having an increased thickness 36 here selected to be the full radius 38 of the barrel 10 less the radius of the bore 26. The front portion 35 of the barrel 10 extends toward the breech end 20 a distance 40 selected to provide the internal tube 12 with a desired mass at the muzzle 16 to in turn enhance the stability or rigidity of the internal tube 12 and the barrel in use.

For the illustrated barrel 10, the internal tube 12 has a length 42 which will vary for the application. The distance 40 may also vary as desired and is typically selected to provide the desired inertia and mass at the muzzle 16.

It can be further seen in FIG. 1 that the wall thickness 44 of the internal tube 12 tapers or decreases from the breech end 20 toward the muzzle 16 for a distance 46 here shown to be about one-half the distance 48 as illustrated. Over the remaining distance 50, the thickness 44 remains substantially constant and is sized to provide the internal tube 12 with desired hoop strength and the strength to sustain the pressures of the gas.

A plurality of longitudinal ribs 52A, 52B, 52C, 52D and 52E radiate from the exterior surface 54 of the internal tube 12 along the length 48 as shown. Each rib 52A, 52B, 52C, 52D and 52E (FIG. 2) is shown extending outwardly from the surface 54 of the internal tube 12 to the outer tube 56 which is here shown to be cylindrical. Each of the ribs 52A–E contact outermost surfaces of the front portion 35 and the breech end 20. The ribs 52A–E may have sections such as 58A, 58B, 58C, 58D and 58E (FIG. 1) which are shown separated and spaced apart to contact the outer tube 56 and provide radial support for the outer tube 56.

The outer barrel 56 is coupled to the front portion 35 and breech end 20 by machine threads or other similar attachment means. Outer tube 56 is fit snugly to the front portion 35 and the breech end 20 to form a chamber 60 to contain propellant gas in the chamber 60 formed or defined by the outer tube 56 and surface 54 of inner tube 12. The outer tube 56 also provides some longitudinal support or rigidity axially 61 for the barrel 10. In one application, the outer tube 12 is made of 4130 steel with a wall thickness of approximately 0.0040.

In FIG. 1, the aperture 62 is formed to be a single opening around the entire circumference of surface 68. In FIG. 2, the internal tube 12 is modified to show apertures 62A through 62E which are proximate the muzzle end 14 and which are formed through the internal tube 12 to be in fluid communication between the bore 26 and the chamber 60. The apertures 62A–E may be a plurality of single openings as indicated in FIG. 2 or a single opening about the entire perimeter or circumference of the inner tube 12. The apertures 62A–E taper or become larger in cross-section from inner surface 68 of tube 12 to outer surface 54 of tube 12.

A bullet 32B is shown in FIG. 1 within the bore 26. As described, wall thickness 44 varies to withstand the varying peak pressures that occur along the length 48 as the bullet 32B travels through the inner tube 12. Close to the chamber 28, the peak pressure occurs some time after the bullet 32A has passed because the propellant is continuing to burn. Nearer the muzzle end 14, generally along length 50, the peak pressure that is experienced is sufficiently low that the inner tube 12 may have a substantially uniform cylindrical shape.

The construction of the barrel 10 may vary in weight, length, thickness and the like for various weapons. Indeed, the number of ribs 52 may vary from no less than three to more than 12. Although a plurality of chambers may be formed by sealingly securing each rib to the outer tube 56, it is preferred to have the chamber 60 so that the gas pressure is equally distributed against the outer tube 56.

In operation, combustion of the propellant charge from a cartridge 30 in the chamber 28 generates a high pressure propellant gas which drives the bullet 32A and 32B through the bore 26 of the internal tube 12. The bullet 32A and 32B accelerates to a desired velocity in its travel through the bore 26 before encountering aperture means such as apertures 62A–E. The length 64 of the apertures 62A–E is selected to be less than the length 66 of sealing contact between the bullet 32B and the internal surface 68 of the bore 26.

For a typical rifle or pistol, the length 66 of engagement of the bullet with the rifling in the surface 68 is greater than three times the radius 39. Thus, the axial length 64 of the apertures 62A–E is less than the length of engagement of the bullet or less than three times the radius 39. Since the seal of the bullet 32B to the surface 68 of bore 26 is longer than the apertures 62A–E, the bullet 32B traverses the apertures 62A–E and continues on to the muzzle end 14 without loss of obturation.

After the bullet 32B traverses the apertures 62A–E as illustrated in FIG. 1, propellant gas continues to urge the bullet 32B through the bore 26, and also vents through apertures 62A–E into chamber 60. The apertures 62A–E are larger in section than the bore (twice the bore area for a full-circumference aperture one radius 39 in length and proportionately greater area for a longer aperture), so that flow of fluid (gas) through the apertures 62A–E is greater than the flow toward the muzzle 16 in the bore 26. Thus, the gas pressure behind the bullet 32B drops rapidly. The pressure of propellant gas is thereby reduced substantially before the bullet 32B exits the muzzle 16 and obturation is lost. In turn, muzzle blast is greatly reduced. In turn, the perceived noise or report is reduced. Further, the muzzle flash may be reduced while the user experiences increased accuracy.

The extension 69 of the outer tube 56 directs the shock wave emanating from the muzzle end 14 in the forward direction. The perceived noise for the shooter is thereby further reduced.

After the bullet 32B exits the muzzle end 14, propellant gas begins to return from the enclosed chamber 60 through the apertures 62A–E into the bore 26 and from the bore 26 to the muzzle 16 until atmospheric pressure is reached throughout the gun barrel structure. While the total mass flow from the port 18 is the same as for a conventional gun barrel, the flow occurs over a much longer period of time and at much lower velocity. A reduction of gun recoil is thus obtained since the reaction of the device is equal and opposite to the sum total of the product of mass and velocity of the expelled matter.

A reduction in muzzle jump is also obtained for two reasons. The first is that the reduced reaction has an angular component which is correspondingly reduced. Second, the forward mass distribution of the front portion 35 causes an increase in the major moment of inertia, and thus results in less angular velocity for a given angular moment.

Figures 3, 4:
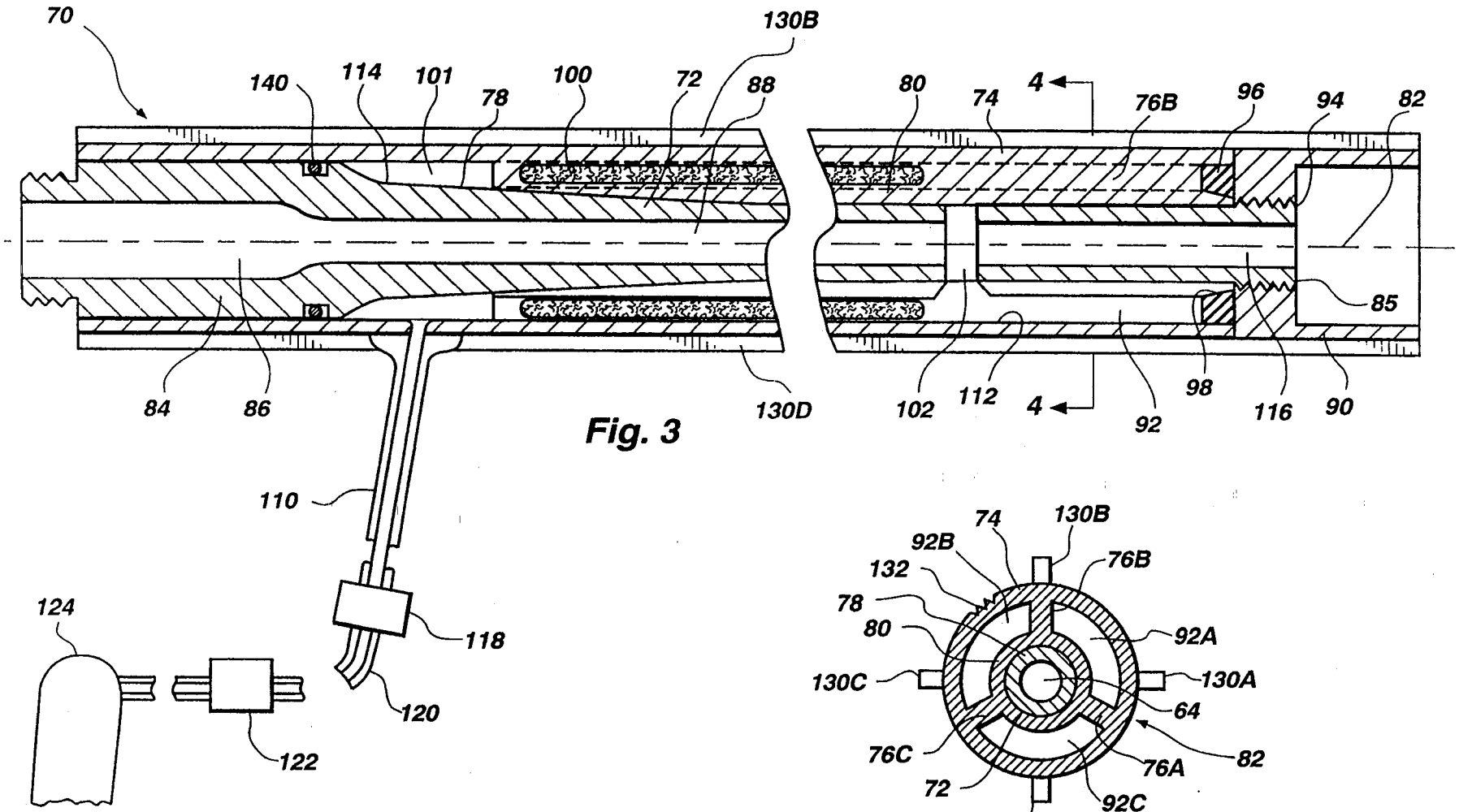
FIG. 3 is a longitudinal cross-sectional view of another barrel of the invention.
FIG. 4 is a cross-sectional view of the structure of FIG. 3 taken along the line 4—4.

Referring to FIGS. 3 and 4, an alternative high performance gun barrel 70 is illustrated. The barrel 70 is similar in shape, form and construction to the barrel 10 of FIGS. 1 and 2 except as discussed hereafter. The barrel 70 has an internal tube 72 which may be lathe turned. It is connected to the outer tube 74 by any means to secure the two and to provide for gas retention in chamber 92. The outer tube 74 may be manufactured by extrusion and tempering. It may also be formed with spacing ribs 76A, 76B and 76C to extend inwardly from the outer tube 74 to snugly contact surface 78 of the inner tube 72. Alternately, the outer tube 74 may have an inner tubular sleeve 80 which is placed snugly and in interference fit over surface 78 of the inner tube 72. The interference fit enhances heat transfer, and serves to support and maintain the rigidity on axis 82 of the inner tube 72 and the outer tube 74.

The outer tube 74 is assembled in interference fit over the chamber portion 84 of the inner tube 72 to enhance structural rigidity and enhance heat transfer from the chamber 86 and the bore 88 to the outside of the barrel 70. At the same time, the interference fit provides a gas-tight seal between the inner tube 72 and the outer tube 74.

The outer tube 74 may be made from an aluminum alloy or other suitable material to provide enhanced heat conduction through the inner tube 72 to the atmosphere and also to provide lighter weight for the gun barrel 70. Aluminum is preferred because of its relatively low cost. It also is relatively light-weight to reduce or control the overall weight of the barrel 70. Aluminum is also believed to be adequate to act as a burst shield in the event the inner tube 72 were to burst or explode. The outer tube 74 may also include the ribs 76A, 76B and 76C to facilitate or simplify construction of the inner tube 72.

The muzzle end extension 90 of the outer tube 74 is here shown threadedly and removably attached by threads 94 for access to the barrel subchambers 92A, 92B and 92C which in total equal chamber 92. As the extension 90 is threaded onto the inner tube 72, the compression seal 96 is compressed to provide a gas-tight seal. In FIG. 3, the tubular sleeve 80 has an inclined surface 98 to compress the seal 96 as it is urged by the extension 90.

Also illustrated is a finely divided heat absorbing material 100 which rapidly absorbs heat from the propellant gas as it enters the chamber 92 through aperture 102. One preferred material is steel wool.

In an alternate arrangement, a tube attachment 110 is provided for introducing a coolant fluid (e.g., a gas such as air, nitrogen or carbon dioxide) which absorbs heat from the absorbing material 100 and also from the inner surface 112 of the outer tube 74, the surfaces of the spacing ribs 76A–C, and the outer surface 114 of the inner tube 72. After absorbing heat, the coolant gas is expelled from the muzzle 116 of the gun. The coolant supply tube 110 may incorporate a check valve 118 to protect the coolant supply from the pressure shock that occurs when the gun is fired. The check valve 118 is interconnected by tubing 120 to a firing valve 122 that is connected to be operated at firing by mechanical means (trigger) or by gas from the bore 88 to release the coolant from the source 124.

The outer tube 74 may also have a plurality of cooling fins 130A, 130B, 130C and 130D connected or formed to extend therefrom to enhance heat transfer. Alternately, for some applications, the barrel can have a plurality of grooves 132 or corrugations to increase surface area and heat transfer.

In reference to FIGS. 3 and 4, it may be noted that an O-ring seal 140 is shown between the outer tube 74 and the inner tube 72 near the chamber 86 to retain gas within the chamber 92. Although an O-ring 140 is shown, other seal structures may be used as desired.

The ribs 76A, 76B and 76C may be removed in the area 101 so coolant may flow more freely between subchambers 92A, 92B and 92C.

Although the invention has been described with a certain degree of particularity in structure, reference herein to details of the illustrated embodiments has been made by way of example only, and numerous changes in structural details may be resorted to without departing from the scope of the following claims.

What is claimed is:

1. For accelerating a projectile advanced by a propellant to an exit velocity, a barrel comprising:

an inner tube with a longitudinal axis and a length and having a wall with an external surface and an internal surface to define a bore, said internal surface sized to make obturating contact with a projectile along said length, said inner tube having a muzzle and an aperture formed in said wall proximate to and spaced inwardly from said muzzle in fluid communication with said bore; and an outer tube sealing said inner tube therein to form a chamber in fluid communication with said aperture in said inner tube, said aperture being positioned to receive said propellant after said projectile achieves substantially the exit velocity.

2. The barrel of claim 1, wherein said barrel includes a plurality of ribs disposed axially to extend between said external surface of inner tube and said outer tube.

3. The barrel of claim 1, wherein said outer tube includes a plurality of axial cooling fins radially disposed on said external surface.

4. The barrel of claim 1, including means for supplying a fluid coolant into said enclosed chamber.

5. The barrel of claim 1, wherein said projectile has a seal length, and wherein said aperture is sized to be less than said seal length.

6. The barrel of claim 1, wherein said chamber substantially surrounds said inner barrel.

7. The barrel of claim 1, wherein said inner tube has a length, a breech end and a muzzle end, and wherein said aperture is positioned at a single axial position in said wall of the inner tube in the half of said inner tube toward said muzzle end.

8. The barrel of claim 7, wherein said breech end has a wall thickness which reduces along a portion of the length thereof toward said muzzle end.

9. The barrel of claim 7, wherein said outer tube is a cylinder with said inner tube sized to be secured therein to seal a gas therebetween when the muzzle is obturated by a projectile.

10. The barrel of claim 9, wherein said outer tube has a portion extending rearwardly away from the muzzle end of said inner tube.

11. The barrel of claim 1, wherein said chamber contains heat absorbing material for absorbing heat from said propellant.

12. The barrel of claim 11, wherein said heat absorbing material is a solid formed to have a high surface area to volume ratio.

13. The barrel of claim 12, wherein said heat-absorbing material is a finely divided material.

14. The barrel of claim 11, wherein said heat-absorbing material is a refractory fiber.

15. The barrel of claim 12, wherein said heat-absorbing material is similar in structure to steel wool.

16. A gun barrel for accelerating to an exit velocity a bullet in obturation of a pressurized fluid comprising:

an internal tube having an external surface, a longitudinal axis, a length, a bore therethrough having a generally cylindrical internal surface sized to make obturating contact with said bullet along the entire said length and defining a generally cylindrical wall separating said internal and external surfaces, a breech end having access proximal thereto for introducing said bullet into said bore, a muzzle end having a port therein in fluid communication with said bore for discharge of said bullet from said bore, and an aperture in said wall proximal said muzzle end positioned to receive and discharge said propellant after said bullet substantially achieves the exit velocity;

an outer tube disposed generally coaxially around said internal tube, said outer tube being coupled to said internal tube proximal said muzzle end and said breech end to seal said internal tube therein, and said outer tube being spaced apart from said internal tube between said muzzle end and said breech end; and an enclosed chamber comprising a volume between said spaced apart internal tube and outer tube sealed with respect to the atmosphere, said chamber being in fluid communication with said aperture in said internal tube for receiving a substantial portion of said pressurized fluid upon traverse of said aperture by said bullet.

17. The gun barrel of claim 16, wherein at least three spacers are disposed in said enclosed chamber between said spaced apart internal tube and outer tube.

18. The gun barrel of claim 16, wherein said internal tube includes a plurality of axial cooling fins radially disposed on said external surface.

19. The gun barrel of claim 16, wherein said outer tube extends beyond said muzzle end of said internal tube.

20. The gun barrel of claim 16, wherein said enclosed chamber contains heat absorbing material having a high surface area to volume ratio for absorbing heat from said pressurized fluid.

21. The gun barrel of claim 16, including means for supplying a fluid coolant into said enclosed chamber.

22. The gun barrel of claim 16, wherein said internal tube is formed to have a substantial portion of the mass thereof positioned proximate said muzzle end.

23. The gun barrel of claim 17, wherein said at least three spacers are disposed on said external surface substantially along said longitudinal axis.

24. The gun barrel of claim 16, wherein said outer tube is removably secured to said internal tube.

25. The gun barrel of claim 24, wherein said heat-absorbing material is a refractory fiber or a finely divided material.

26. The gun barrel of claim 24, wherein said heat-absorbing material is steel wool.

* * * * *